US006040032A

United States Patent [19]

Israël et al.

[11] Patent Number: 6,040,032

[45] Date of Patent: Mar. 21, 2000

[54] ABSORBENT ARTICLE FOR COLLECTING NON-AQUEOUS LIQUIDS AND A METHOD FOR MANUFACTURING THE ABSORBENT ARTICLE

[76] Inventors: Joseph Israël, 111 Old Bay Rd., Belcheltown, Mass. 01007; Yvon Levesque, 3103 St. Catherine, Montreal, Quebec, Canada, H1W 2E6

[21] Appl. No.: 08/054,448

[22] Filed: Apr. 28, 1993

[51] Int. Cl.[7] ..... B32B 5/00; B32B 9/04; B27N 3/00

[52] U.S. Cl. ..... 428/98; 264/109; 428/411.1; 502/401

[58] Field of Search ..... 210/611, 622, 210/682; 435/262.5; 252/610, 301; 502/402, 401; 428/98, 411.1; 264/109

[56] References Cited

U.S. PATENT DOCUMENTS

| | | | |
|---|---|---|---|
| 3,791,990 | 2/1974 | Fischer | 252/427 |
| 4,497,712 | 2/1985 | Cowling | 210/691 |
| 4,747,960 | 5/1988 | Freeman et al. | 210/689 |
| 4,784,773 | 11/1988 | Sandberg | 210/691 |
| 5,009,790 | 4/1991 | Bustamante | 210/689 |

FOREIGN PATENT DOCUMENTS

| | | | |
|---|---|---|---|
| 387763 | 12/1971 | Canada | 182/11 |
| 939905 | 1/1974 | Canada . | |
| 945982 | 4/1974 | Canada | 252/37 |
| 976141 | 10/1975 | Canada | 252/37 |
| 982951 | 2/1976 | Canada | 182/11 |
| 1091217 | 12/1980 | Canada | 252/20 |
| 1133833 | 10/1982 | Canada | 182/11 |
| 1163570 | 3/1984 | Canada | 182/11 |
| 1208569 | 7/1986 | Canada | 182/11 |

*Primary Examiner*—Wayne Langel
*Attorney, Agent, or Firm*—James P. Barr

[57] ABSTRACT

An absorbent article for collecting non-aqueous liquids such as oil-based products, comprising a low density, structurally integral board of peat moss material manifesting an affinity for non-aqueous liquids while being hydrophobic in order to block undesirable water penetration in the absorbent medium. The invention also extends to a method for manufacturing the absorbent article.

20 Claims, 3 Drawing Sheets

ABSORBENT ARTICLE FOR COLLECTING NON-AQUEOUS LIQUIDS AND A METHOD FOR MANUFACTURING THE ABSORBENT ARTICLE

FIELD OF THE INVENTION

The invention relates to the general field of spill management and, more particularly, to a novel absorbent article utilizing peat moss material for collecting non-aqueous liquids such as oil-based products. The invention also extends to a method for manufacturing the absorbent article.

BACKGROUND OF THE INVENTION

The prior art has recognized the potential of peat moss material for use as an absorbent medium in structures for absorbing aqueous solutions. The remarkable fluid absorption properties of peat moss material have been turned to use in the field of sanitary, disposable absorbent products such as sanitary napkins, tampons, diapers, adult briefs, urinary pads, wound dressings and the like, to provide highly efficient absorbent components which can be made relatively thin for better fit, comfort and discretion, while being sufficiently absorbent to prevent overflow leakage of body exudate and garment staining.

The following United States patents document the use of peat moss material for manufacturing absorbent components for sanitary, disposable absorbent products.

| U.S. Pat. No. | INVENTOR(s) | DATE Of ISSUE |
|---|---|---|
| 4,170,515 | Lalancette et al. | October 9, 1979 |
| 4,215,692 | Levesque | August 5, 1980 |
| 4,226,237 | Levesque | October 7, 1980 |
| 4,305,393 | Nguyen | December 15, 1981 |
| 4,473,440 | Ovans | September 25, 1984 |
| 4,507,122 | Levesque | March 26, 1985 |
| 4,618,496 | Brasseur | October 21, 1986 |
| 4,676,871 | Cadieux et al. | June 30, 1987 |
| 4,992,324 | Dube | February 12, 1991 |
| 5,053,029 | Yang | October 1, 1991 |

The subject matter of these patents is incorporated herein by reference.

Peat moss material can be formed in a highly cohesive, structurally integral board by any one of the methods disclosed in the above-identified prior art. In board form, the absorbent material is more convenient to handle and it can be directly processed in high speed automatic equipment for assembling disposable absorbent products.

Broadly stated, the method developed by the industry for manufacturing a structurally integral peat moss board which is specifically adapted for sanitary usage, comprises the following steps. Raw peat moss, in particulate form, is classified by wet screening in order to retain only the particles which are the most absorbent. The screened fraction is diluted with water to form a slurry having a pumpable consistency which is sheeted on a Fourdrinier wire and dewatered by the sequential application of vacuum and heat. The thus formed board is calendered at high pressure to increase its density primarily for the purpose of enhancing its drying power, i.e. the ability of the absorbent medium to continuously pull and wick fluid away from adjacent materials such that virtually all the fluid is collected in the peat moss core. This consideration is particularly important for sanitary absorbent products which are intended to remain in contact with the skin of the wearer for an appreciable period of time. In such applications, the capability of the peat moss core to extract moisture from the fluid permeable cover of the sanitary product which receives the discharge of body exudate is a highly desirable attribute as it allows to impart to the fluid permeable cover a feeling of "dryness" which makes the absorbent product more comfortable to wear.

During the formation stage of the peat moss board, the aqueous slurry is treated with a wetting agent (hereinafter "wetting agent" shall be construed to encompass any substance which imparts hydrophilicity or enhances the hydrophilicity of the peat moss material), such as a surfactant, to provide the peat moss board with a strong affinity for water. Typically, the wetting agent is added to the peat moss slurry at the vacuum dewatering stage by spraying or by any other appropriate deposition method. The pressure differential established across the Fourdrinier wire to extract dilution water constitutes the agency which causes the wetting agent to penetrate deeply in the peat moss slurry.

The prior art also recognizes the efficiency of peat moss material to absorb non-aqueous liquids such as a variety of chemical products and specifically oil-based materials. The waste management industry has been using peat moss as an absorbent medium for the removal of non-aqueous, liquid pollutants, for many years. Typically, dried particulate peat moss packaged into liquid permeable pouches is delivered to the contaminated area and placed in contact with the liquid spill to absorb the pollutant. By virtue of the relatively low density of peat moss material in particulate form, the absorbent pads have the ability to float on water and can be used for recovering non-aqueous, liquid pollutants floating on a body of water, such as an oil slick on sea surface for example.

Although particulate peat moss material has the ability to collect and trap many times its own weight of oil-based products and a variety of other chemicals, the configuration of the absorbent pads made from this material is not well suited for the recovery of large scale spills. Granular peat moss material has virtually no structural integrity, and when it is loaded into a flexible containment pouch, the resulting absorbent pad assumes the shape of a bag, i.e. a bulbous round body in which the ratio outer surface/volume is relatively low. As a result, the liquid take-up rate is low which requires a longer residence time of the absorbent pad in the spill in order to reach the saturation level. This drawback is particularly significant for applications where the absorbent pad is subjected in use to vigorous movements by natural forces, such as sea waves or wind, having a tendency to separate the absorbent pad from the spill. In such applications a high fluid take-up rate is highly desirable to allow an efficient utilization of the available absorbent material.

Having regard to the foregoing, a primary objective when designing an absorbent pad for spill management purposes should be to attain the broadest possible outer surface in order to increase the contact surface with the liquid pollutant and therefore to enhance the liquid take-up rate. A suitable shape would be a sheet-like or a board-like configuration which is characterized by a broad outer surface and little thickness.

However, granular peat moss material which is currently used by the industry is unsuitable for making board-shaped absorbent pads because it has little or no ability to maintain a predetermined shape, unless one uses a liquid permeable pouch which cumulates the functions of a containment envelope and of a structural member to impart to the absorbent material a certain shape. However, for cost-considerations, this option is unpractical.

To compensate for the limited outer surface of conventional absorbent pads, one may use a larger number of pads for a given amount of liquid pollutant. The drawback behind this approach is twofold. Firstly, a larger number of absorbent pads makes the recovery operation more expensive. Secondly, this practice, in itself, may create an environmental hazard because the pouches used to contain the loose peat moss material are made from a non-biodegradable plastic such as a non-woven polyester fabric, therefore if some absorbent pads drift away during the recovery operation and are lost they will contaminate the environment.

It has also been suggested in the past to apply peat moss material to the liquid pollutant in particulate form and subsequently to recover the peat moss material with the liquid pollutant trapped therein. This method avoids the difficulties associated with absorbent pads made of granular peat moss material packaged in liquid permeable pouches, however, this use is restricted only to land or hard surfaces and on spills of limited extend. Loose peat moss material cannot be practically used for large-scale spills on land or on water because the recovery of the spent absorbent is strenuous and costly due to its particulate nature.

OBJECTS OF THE INVENTION

An object of the invention is to provide an absorbent article for collecting non-aqueous liquids, such as oil-based products and a variety of other chemicals, utilizing peat moss material as an absorbent medium, which is relatively inexpensive and simple to produce and which has a comparatively broad exterior surface providing a high fluid take-up rate.

An underlying object of the invention is an absorbent article having the above stated properties and which is also buoyant, thereby being capable of recovering liquids floating on a body of water.

Another object of the invention is a method for manufacturing the aforementioned absorbent article.

SUMMARY OF THE INVENTION

The present inventors have made the unexpected discovery that peat moss material formed into a hydrophobic, structurally integral board (hereinafter, the term "board" is intended to encompass sheet-shaped objects which are not necessarily rigid, such as a flexible mat) provides an absorbent article suitable for recovering a large variety of non-aqueous liquids, which is relatively simple and inexpensive to mass produce and it is characterized by an exceptional absorbent capacity and a high liquid take-up rate. A significant advantage of the invention over the prior art resides in that the peat moss board does not require a discrete, confining structure, such as the liquid-permeable pouch used in traditional absorbent pads. This results into a cost-effective, environmentally sound absorbent article.

Experimental work conducted on the absorbent article in accordance with the invention has demonstrated a definite correlation between the density of the peat moss board and its absorbent capacity. More specifically, it has been established that by decreasing the density of the peat moss board, its absorbent capacity increases.

It is important to note that the density of the peat moss board also influences its strength and resistance characteristics. Therefore, a very low density board, albeit having a very high absorption capacity, is not necessarily desirable because it may be subject to structural failures in operation, especially when the board becomes saturated with liquid.

A possible approach to increase the resistance of the peat moss board without significantly adding to its density is to use a laminated form of construction by bonding to the peat moss material one or more thin layers having a relatively high tensile strength.

In a preferred form of construction, the laminated peat moss board comprises an absorbent core of peat moss material sandwiched between thin layers of fibrous material such as Kraft wood pulp. In a preferred embodiment, the overall density of the structure is in the range from about 0.02 grams per cubic centimeter (g/cc) to about 0.20 g/cc (all density measurements provided in this specification are effected on samples at 12% moisture level). More preferably, the density is in the range from about 0.05 g/cc to about 0.15 g/cc. Most preferably, the density of the board is in the range from about 0.05 g/cc to about 0.10 g/cc.

A critical aspect of the invention is the ability of the peat moss board to shed water while being capable of absorbing non-aqueous liquids, such as oil-based products. Such selective absorption properties allow to provide an absorbent article which can be successfully used for recovering a non-aqueous liquid present into an environment containing a significant amount of water, for example an oil slick floating on sea surface. The low density of the peat moss board confers buoyancy to the absorbent article allowing same to float on the water surface exactly where the non-aqueous liquid is located. Further, the water repellency of the peat moss board prevents undesirable saturation of the absorbent article with water, thereby maintaining the absorbent medium active for capturing the non-aqueous liquid.

Throughout this specification, the peat moss board in accordance with the invention will be described as hydrophobic with reference to its ability to prevent ingress of water within the absorbent medium. This terminology takes into account only the general behaviour of the peat moss board and does not imply that each of its constituents has no affinity for water. For example, in the laminated form of construction described earlier utilizing an absorbent core of peat moss material sandwiched between thin layers of Kraft wood pulp, the peat moss board is not perfectly hydrophobic since the reinforcing Kraft pulp layers are capable of some water absorption which, however, is minimal and can be disregarded in practice. In such exemplary form of construction, when a small amount of water is deposited on the outer surface of the absorbent article, the water will penetrate within the Kraft wood pulp layer, however, it will be arrested therein and it will not be able to propagate within the absorbent core. Therefore, the saturation level to water of the absorbent article is extremely low and does not affect its selective absorption properties in any significant way.

It will be plain to a person skilled in the art that the hydrophobicity of the peat moss board can be perfected by treating the Kraft wood pulp layers with a suitable water repelling agent.

As embodied and broadly described herein, the invention also extends to an absorbent article for recovering an oil-based liquid floating on a body of water, the absorbent article including a structurally integral and buoyant board of peat moss material, the board of peat moss material being hydrophobic and oleoliphic, whereby when the board of peat moss material is floated on the body of water in contact with the oil-based liquid, the board of peat moss material selectively absorbs the oil-based liquid without taking-up any significant amount of water.

As embodied and broadly described herein, the invention also extends to a method for manufacturing a low density, structurally integral article for collecting non-aqueous liquids, the method comprising the steps of:

a) forming a liquid suspension of peat moss material;

b) sheeting the suspension;

c) extracting fluidizing medium from the suspension to form a low density board of peat moss material;

d) drying the board of peat moss material;

the method being completed without conditioning the peat moss material with wetting agent to preserve a natural hydrophobicity of the peat moss material in order to impede water penetration in the article.

In a most preferred embodiment, raw peat moss material is formed into an aqueous slurry having a pumpable consistency and it is subjected to a classification procedure to eliminate from the peat moss slurry particles having a size substantially smaller than 210 microns and particles having a size substantially larger than 2000 microns, in order to retain only the particles which are the most absorbent. The peat moss slurry is classified by flowing the slurry through a set of screens having the desired mesh size.

The slurry is then delivered on a Fourdrinier wire and dewatered by the sequential application of vacuum and heat to form the absorbent article. If desired, the article may be calendered at a very low pressure solely for the purpose of stabilizing its calliper. Intense calendering is to be avoided because it would have the effect of increasing the density of the peat moss material which adversely affects its absorption capacity.

To manufacture a laminated peat moss board of the type described earlier, a co-forming process may be used which consists of progressively building on the Fourdrinier wire a stratified slurry by successive deposition of water suspension strata corresponding to each layer of the final product.

DESCRIPTION OF PREFERRED EMBODIMENTS

Figure 1:
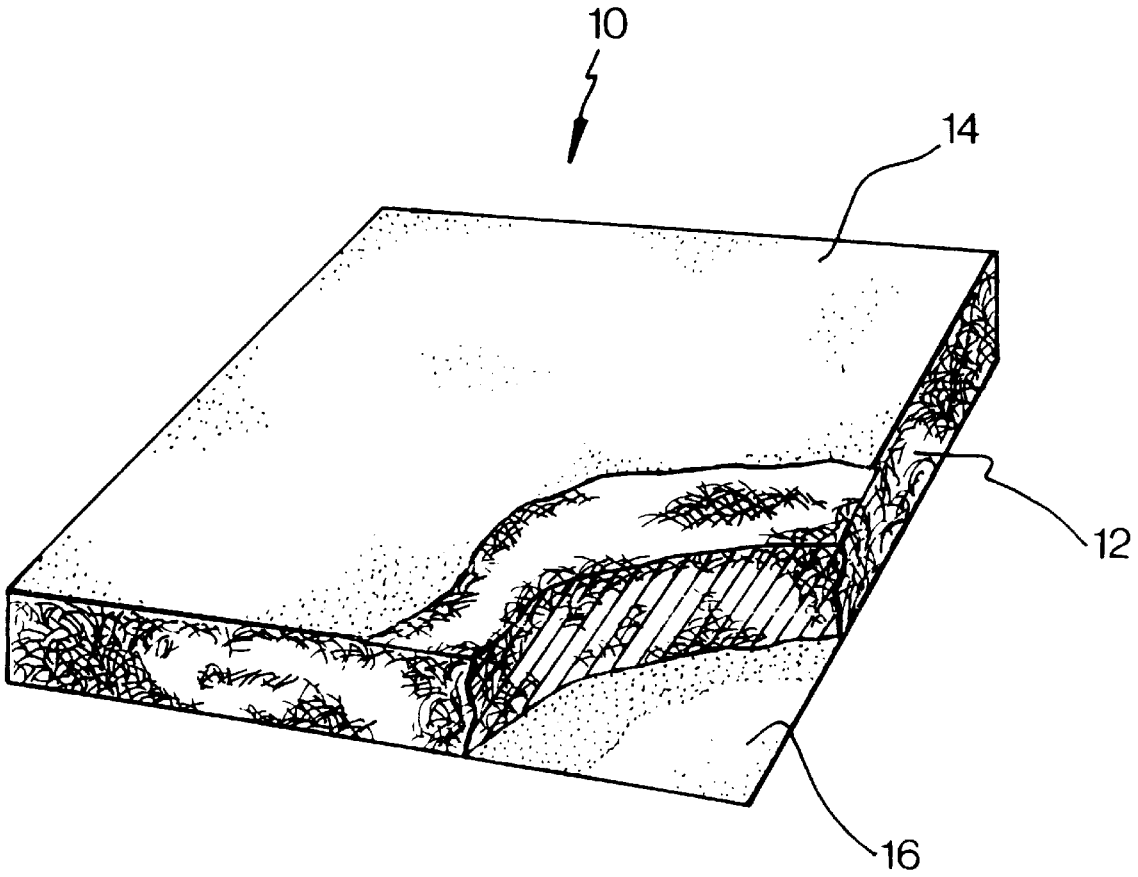
FIG. 1 is a perspective, fragmentary view of an absorbent article constructed in accordance with the present invention.

The structure of an absorbent article constructed in accordance with the present invention which can be used for recovering non-aqueous liquids is illustrated in FIG. 1. The absorbent article, designated comprehensively by the reference numeral 10, has a laminated structure and it is in a form of a relatively flat board comprising a central absorbent core 12 containing primarily peat moss material. The core 12 is confined between reinforcing layers 14 and 16 of fibrous material. The purpose of the reinforcing layers 14 and 16 is to strengthen the absorbent core 12, thereby providing a unitized absorbent structure capable of maintaining its integrity even when saturated with liquid. Kraft wood pulp material has been found highly satisfactory for manufacturing the reinforcing layers 14 and 16. It is also possible to use cotton linters or ground wood in admixture with or in substitution to the Kraft wood pulp material.

Figure 2:
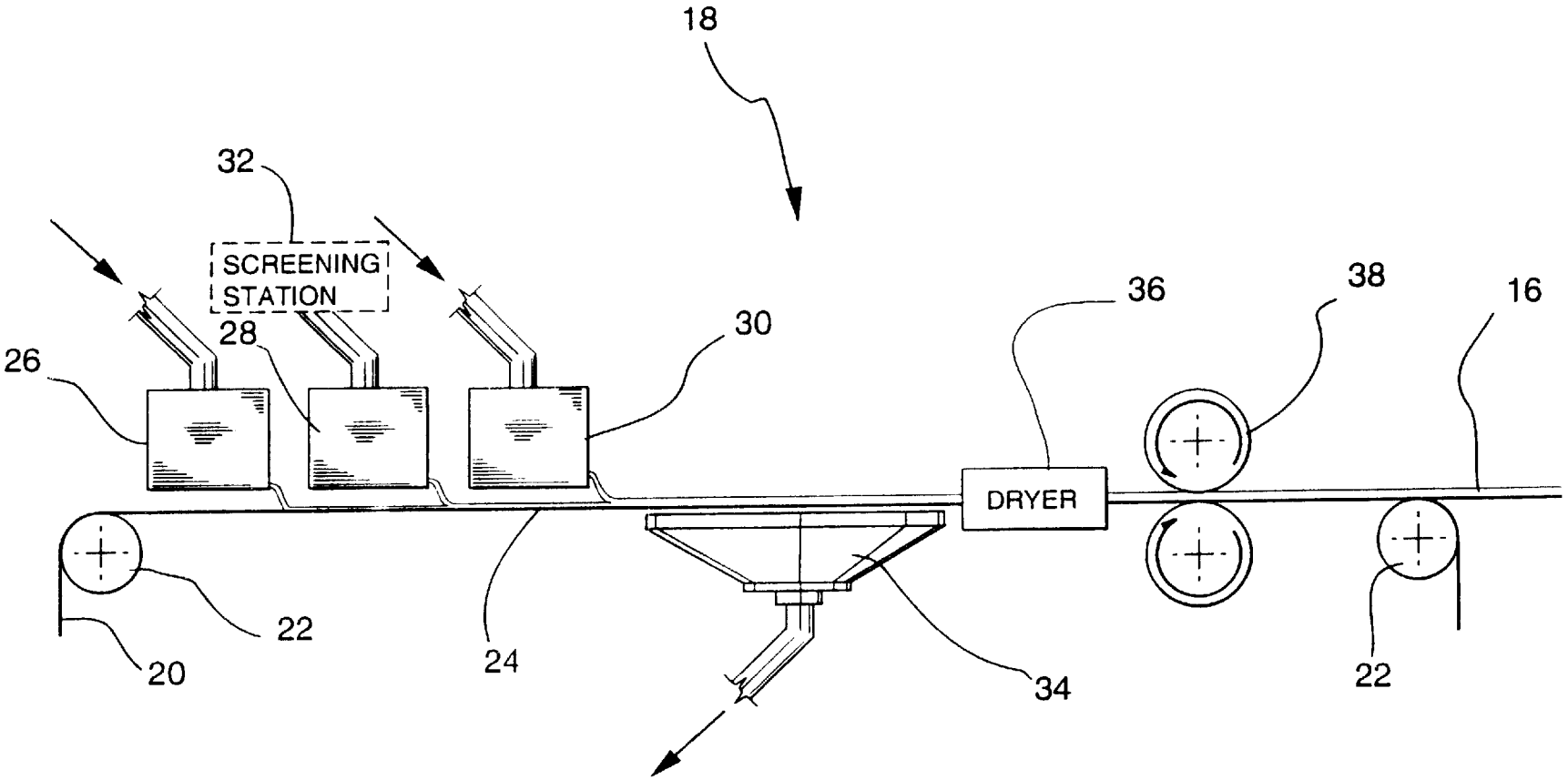
FIG. 2 is a schematical representation of an apparatus for manufacturing the absorbent article shown in FIG. 1.

The detailed composition of the absorbent article 10 will be best understood from the following description of the apparatus and the process for manufacturing such absorbent article. Referring to FIG. 2, the apparatus designated comprehensively by the reference numeral 18, comprises an endless, fluid-pervious Fourdrinier wire 20 which is mounted on rollers 22 to provide a horizontally extending run 24 which is continuously advanced forward to support and convey a slurry of peat moss material and Kraft wood pulp through various processing stations.

Headboxes 26, 28 and 30 arranged in a spaced apart relationship along the path of travel of the wire 20, are provided to lay on the wire 20 slurry in sheeted form. The headbox trio deposits on the wire 20 three layers of slurry in a superposed relationship to form a laminated web. More specifically, the central headbox 28 lays a slurry of peat moss and the headboxes 26 and 30 deliver slurry of fibrous material such as Kraft wood pulp or any other suitable substance.

The peat moss slurry, before being supplied to the headbox 28 is refined at a screening station illustrated schematically in FIG. 2 and identified by the reference numeral 32. The screening station 32 is of a well-known construction and does not require a detailed description herein.

Downstream of the headboxes 26, 28 and 30 is provided a vacuum slot 34 which is in fluid communication with a vacuum pump (not shown in the drawings) in order to create suction beneath the wire 20 for dewatering the slurry thereon.

The next processing station is a dryer 36 whose purpose is to elevate the temperature of the slurry to evaporate water therefrom. The dryer is of a well-known construction and does not require a detailed description herein.

Downstream of the dryer 36 is provided a calendaring station 38 which slightly compresses the dried product in order to stabilize its calliper.

The operation of the apparatus 18 is as follows. The starting peat moss harvested from the bog should have a relatively high absorbent capacity. Peat moss capable of absorbing and retaining at least about 25 and preferably about 50 times its weight in water has been found satisfactory. The starting peat moss is wet classified at the screening station 32 to remove the extremely fine material, commonly referred to as fines, and large pieces of material including roots, branches and the like which do not contribute significantly to the absorbency of the peat moss material.

The classification is carried out such that anything that remains on a number 10 mesh screen (2000 microns) is discarded and anything that passes through a number 70 mesh screen (210 microns) is also discarded. Preferably, anything that remains on a number 14 mesh screen (1410 microns) is discarded and anything that passes through a number 100 mesh screen (149 microns) is discarded.

The peat moss material is classified by a well-known wet screening process which consists of forming an aqueous slurry of the peat moss material and flowing the slurry through successive screens to extract from the slurry the fines and the excessively large particles.

The screened fraction of the peat moss material is then diluted with water to render the slurry more manageable. If desired, a fibrous component may be added at this stage to the slurry. The fibrous component may include such materials as Kraft wood pulp, mechanical wood pulp, cotton linters or jute, among others. As used herein, the term mechanical wood pulp is meant to include ground wood pulp, thermo-mechanical pulp and refiner wood pulp. Ground wood pulp is essentially trees and branches which have been debarked, cleaned and ground into particulate matter. Refiner wood pulp differs from ground wood pulp only in that the grinding step utilizes a refiner, i.e. a disk-like device well-know in the art and having metallic ribs at the peripheral sections thereof which last contact the wood particles and help separate the wood fibers without excessively damaging them. Thermo-mechanical wood pulp is similar to refiner pulp with the exception that the wood particles are heated in the refiner, usually with steam, to aid in separating the wood fibers. The common characteristic of these mechanical pulps is that no attempt has been made to separate the fibers by chemical means although they may later, after being reduced to fine particulate matter, be subjected to a desired chemical treatment, such as bleaching.

Preferably, when mechanical wood pulp is used in the peat moss slurry, such mechanical pulp has a Canadian Standard Freeness (TAPPI TEST METHOD T-227) of from about 60 to 750 and preferably from about 400 to 600.

The Kraft wood pulp, also usable in combination with the peat moss, is essentially chemically treated, long fibred wood pulp such as sulfite and sulfate wood pulps.

The fibrous component may also include a natural or synthetic textile fiber such as rayon, polyester, nylon, acrylic or the like, having a length of from about 0.6 centimeters to about 1.9 centimeters, preferably about 1.3 centimeters and a denier of from about 1.0 to 5.0, present in an amount from 2 to 20% by weight of the absorbent core 12, preferably from 4% to 8%.

The slurry from the headboxes 26, 28 and 30 is sheeted onto the wire 20 and dewatered by the vacuum slot 34. If desired, a conditioning agent may be added to the slurry at this stage, such as a colouring agent, a water-repelling agent (for the purpose of this specification "water-repelling agent" should be construed to include any substance that procures hydrophobicity or enhances the hydrophobicity of the material to which it is applied) an adhesive or others. The selected conditioning agent may be applied to the slurry upstream of the vacuum slot 34 by spraying, coating or otherwise. The pressure differential established by the vacuum slot 34 causes the conditioning agent to penetrate within the peat moss and Kraft wood pulp compositions for an in-depth treatment.

The treatment of the slurry with water-repelling agent is particularly desirable in order to render the Kraft wood pulp layers hydrophobic. Various types of water-repelling agents can be used for the treatment. It is within the reach of the person skilled in the art to select the specific agent most suitable for the intended application.

After initial dewatering, the product is conveyed to the drier 36 for further dewatering by the application of heat. The thus formed board is slightly compressed at the calendaring station 38 for stabilizing the calliper of the board.

It should be pointed out that the calendaring of the laminated peat moss board is conducted at pressure levels significantly lower than the pressure developed when the peat moss board is intended for sanitary usage, where drying power should be enhanced by increasing the density of the absorbent medium. In contrast, for spill management purposes, a lower density is desired in order to increase the absorbent capacity of the peat moss board. Typically, the calendaring pressure in the process according to the invention is about one tenth of the pressure which would be normally applied if the peat moss board was intended for sanitary applications.

After the calendaring is completed, the continuous peat moss board is cut (this operation is not shown in the drawings) to form discrete absorbent articles having the desired size and shape. Preferably, the cutting pattern is selected in such a way as to minimize waste. Square or rectangular shapes have been found satisfactory in this regard.

In a specific embodiment of this invention, a slurry of Kraft wood pulp having a consistency of about 0.2% by weight of solids is first laid down on the wire 20 from the headbox 26. The slurry flow rate is selected to deliver on the wire 20, 15 grams of solids per square meter. The Kraft slurry passes under the headbox 28 which delivers on top of the Kraft layer a slurry of peat moss material having the following composition by weight of solids:

Sphagnum peat moss ≈ 74.3%

Kraft wood pulp fibers ≈ 21.0%

Polyester fibers ≈ 4.7%

The consistency of the peat moss slurry is set at 0.5% by weight of solids. The flow rate of the peat moss slurry is selected to deliver 300 grams per square meter of solids on the wire 20.

A final Kraft wood pulp slurry layer is laid from the headbox 30 on the peat moss slurry. This final layer is identical in terms of consistency, flow rate and composition to the bottom Kraft wood pulp layer previously deposited.

The laminated slurry is passed over the vacuum slot 34 to extract water under the influence of a pressure differential established across the slurry. Precise regulation of the residence time of the slurry over the vacuum slot and the vacuum intensity is critical for accurate density control of the final product. Generally, decreased vacuum and increased speed will result in a less dense product. Conversely, increased vacuum and decreased speed will produce a denser product. In a preferred embodiment, the speed of the wire 20 is set at 28.96 meters per minute. The vacuum slot 34 is constituted by a set of 6 elongated orifices which are parallel and are oriented transversely to the direction of travel of the wire 20. Each orifice has a width of 25.4 centimeters. Collectively, the orifices provide an interval of about 3 seconds during which the slurry is exposed to vacuum. The intensity of the vacuum ranges from about 200 to about 315 millimeters of mercury.

The dewatered product is then dried in the dryer 36 by subjecting the product to a temperature above 100° C. in order to evaporate residual moisture. The high temperature treatment is desirable because it has been found to enhance the hydrophobicity of the peat moss material.

Subsequently, the dried product is calendared at the calendaring station 38 to control its calliper. A calendaring pressure of approximately 275 kilograms per linear meter is used. The resulting laminated peat moss board has a density of 0.077 g/cc.

The calendaring pressure applied on the peat moss board is dependent on the characteristics of the calendaring equipment that is being employed. In other words, different calendaring stations may develop exactly the same pressure at the nip, thus conditioning the calendared material in the same way, although the pressure reading in kilograms per linear meter is different for each station.

For the purpose of repeatability of the process conditions set forth herein, the calendaring station that has been used to slightly compress the peat moss board has the following characteristics:

a) a top roll having a diameter of 42.929 centimeters, a length of 91.440 centimeters, a hardness of 75/82 shore C and a crown of 0.11557 millimeters; and b) a bottom roll having a diameter of 45.664 centimeters, a hardness of 76/80 shore C and a crown of 0.10541 millimeters.

It should be appreciated that the calendaring operation enables the operator to control the density of the final product. However, this control lever is seldom used because it can only increase the density of the peat moss board which adversely affects its absorption capacity. Therefore, in practice, the calendaring station is set at the minimum pressure which will be sufficient to stabilize the calliper of the peat moss board.

A critical parameter of the process in accordance with the invention is that no attempt has been made to enhance the hydrophilicity of the peat moss board. This is contrary to conventional processes for the manufacture of peat moss boards, specifically designed for sanitary usage, where the absorbent medium must be capable of absorbing aqueous solutions. The preservation of the natural hydrophobicity of the peat moss material is an important characteristic of this invention which allows to produce an absorbent article capable of selective fluid absorption.

Figure 3:
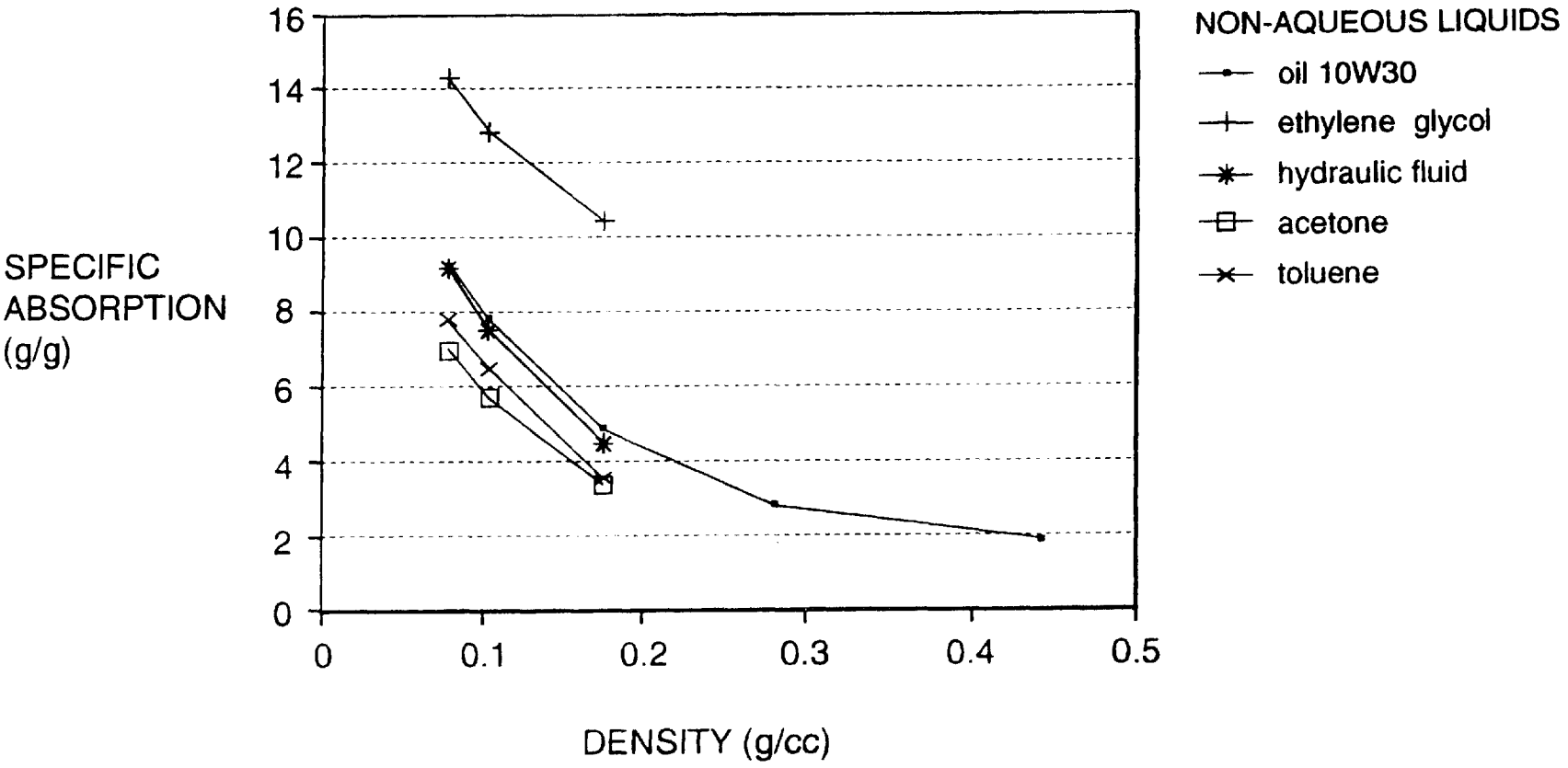
FIG. 3 is a graphical representation of the relationship between the density of the absorbent article and its absorption capacity, for various types of non-aqueous liquids.

The following table considered in conjunction with the graph of FIG. 3, illustrates the relationship between the density of the laminated peat moss board and its absorbent capacity for various non-aqueous liquids. The table also provides a qualitative measure of the ability of the peat moss board to retain liquid absorbed in its structure. The various samples of peat moss boards considered in the comparative test have identical compositions, and weight and differ solely by their density. These samples have been produced by following the steps of the process set forth above, except that for samples B,C D and E the calendaring pressure has been progressively increased in order to achieve a higher density. It should be appreciated that some of these samples, the most denser for instance, are not necessarily considered to be useful in practice due to their poor absorbency characteristics, and their purpose is only to illustrate the relationship between the density of the peat moss board and its absorbent capacity.

The description of the various test procedures to which the samples A,B,C,D and E have been subjected, are described in the section entitled "TEST PROCEDURES" following the table.

TABLE

| | SAMPLES | | | | |
|---|---|---|---|---|---|
| DENSITY (g/cc) | A 0.077 | B 0.104 | C 0.176 | D 0.283 | E 0.444 |
| MOTOR OIL (10W30 viscosity grade) | | | | | |
| ABSORBENT CAPACITY | 1:9.3 | 1:7.7 | 1:4.8 | 1:2.8 | 1:1.9 |
| RETENTION | medium | medium | medium | medium | weak |
| ETHYLENE GLYCOL | | | | | |
| ABSORBENT CAPACITY | 1:14.2 | 1:12.7 | 1:10.3 | — | — |
| RETENTION | medium | medium | medium | — | — |
| HYDRAULIC FLUID | | | | | |
| ABSORBENT CAPACITY | 1:9.1 | 1:7.4 | 1:4.4 | — | — |
| RETENTION | medium | medium | medium | — | — |
| ACETONE | | | | | |
| ABSORBENT CAPACITY | 1:6.8 | 1:5.6 | 1:3.3 | — | — |
| RETENTION | good | good | good | — | — |

TABLE-continued

| | SAMPLES | | | | |
|---|---|---|---|---|---|
| DENSITY (g/cc) | A 0.077 | B 0.104 | C 0.176 | D 0.283 | E 0.444 |
| TOLUENE | | | | | |
| ABSORBENT CAPACITY | 1:7.7 | 1:6.4 | 1:3.5 | — | — |
| RETENTION | good | good | good | — | — |

DESCRIPTION OF TEST PROCEDURES

Absorbent Capacity

The absorbent capacity test is used to determine the maximum amount of test liquid that a sample can pick-up. The test procedure comprises the following steps:

1) The sample to be tested is cut in the form of a square of 130 mm by 130 mm. The sample is then weighted and its value recorded;

2) A test cell is prepared by filling a receptacle with an initial layer of water (100 mm or more) and a quantity of test liquid to produce the required thickness for the test. The required thickness for motor oil, ethylene glycol and hydraulic fluid is 5 mm. For acetone and toluene the thickness is of 2.5 mm; and 3) The sample is placed in the test cell and it is allowed to float on water while it remains in contact with the test liquid. At the 8 minute mark the sample is turned over. After 15 minutes, measured from the sample introduction in the test cell, the sample is removed from the test cell and it is allowed to drain. The sample is then weighted and from the measurement is subtracted the weight of the dry sample in order to determine the weight of the test fluid collected by the sample. The absorbent capacity of the sample is expressed as a ratio between the weight of the test fluid collected by the sample and the weight of the dry sample.

Retentivity

The retentivity is defined as the ability of a sample to hold test fluid. The test procedure comprises the following steps.

1) The sample to be tested is cut in the form of a square of 130 mm by 130 mm. The sample is then weighed and its value recorded;

2) A test cell is prepared by filling a receptacle with a quantity of test liquid to produce the required thickness for the test. The required thickness for motor oil, ethylene glycol and hydraulic fluid, is 10 mm. For acetone and toluene, the thickness if of 7.5 mm; and 3. The sample is placed in a foraminous basket and lowered into the test cell. At the 8 minute mark, the sample is turned over. After 15 minutes, measured from the sample introduction in the cell, the sample is removed with the basket and allowed to drain for 30 seconds. The retentivity is defined as follows:

1) High retention (less than 12 drops per minute);

2) Medium retention (between 12 and 60 drops per minute);

3) Low retention (between 60 and 120 drops per minute);

4) Failure (above 120 drops per minute).

DISCUSSION

With reference to FIG. 3, the graphical representation of the data given in the table clearly illustrates a definite correlation between the density of the peat moss board and its absorbent capacity for the various non-aqueous liquids that are being used in the experiment. More particularly, it is apparent that by decreasing the density of the peat moss board, the absorbent capacity increases approximately in an exponential fashion. Accordingly, even a small density decrease can yield significant gains in absorption capacity. This is particularly true for density values below 0.2 g/cc.

The relationship between the density and the absorbent capacity is valid and confirmed for each test fluid. Although the absolute absorbent capacity changes according to the particular test fluid, the relationship is clearly observable in each case.

The results of the liquid retentivity test reported in the table demonstrate that the density of the peat moss board does not significantly affect its liquid retentivity. Rather, the ability of the peat moss board to prevent absorbed liquid from escaping the absorbent medium is largely dependent upon the nature of the liquid. For example, the peat moss board has a higher retentive power in connection with acetone and toluene than with regard to motor oil (viscosity grade 10 W 30), ethylene glycol and hydraulic fluid.

In use, to recover a spill of a certain non-aqueous liquid, the absorbent article in accordance with the invention is directly contacted with the liquid, such as by depositing the peat moss board in the spill, until the absorbent article is fully soaked with liquid. The spent absorbent article is then removed and treated in accordance with the applicable waste management techniques and regulations. The buoyancy and the ability of the absorbent article to block the penetration of water within the absorbent medium is advantageous for recovery operations conducted in an environment where large amounts of water are present, such as for example oil floating on sea surface. By dispersing on the water a sufficient number of absorbent articles to adequately cover the oil slick, the pollutant is collected within the peat moss boards which remain afloat even when soaked with liquid. As a result, the retrieval of the pollutant can be accomplished rapidly and in a cost-effective manner.

The scope of the present invention is not limited by the description, examples and suggestive uses herein as modifications and refinements can be made without departing from the spirit of the invention. Thus, it is intended that the present application covers the is modifications and variations of this invention provided that they come within the scope of the appended claims and their equivalents.

We claim:

1. An absorbent article for collecting a non-aqueous liquid comprising a low density, hydrophobic, structurally integral board of peat moss material manifesting an affinity for the non-aqueous liquid, wherein said board of peat moss material is capable of absorbing the non-aqueous liquid under the effect of capillary pressure.

2. An absorbent article as defined in claim 1, wherein said board of peat moss material is oleoliphic and capable of absorbing oil-based products.

3. An absorbent article as defined in claim 1, wherein said board of peat moss material has a density in the range from about 0.02 g/cc to about 0.20 g/cc.

4. An absorbent article as defined in claim 1, wherein said board of peat moss material has a density in the range from about 0.05 g/cc to about 0.15 g/cc.

5. An absorbent article as defined in claim 1, wherein said board of peat moss material has a density in the range from about 0.05 g/cc to about 0.10 g/cc.

6. An absorbent article as defined in claim 1, wherein said board of peat moss material has a laminated structure including a reinforcing layer to enhance a structural integrity of said absorbent article.

7. An absorbent article as defined in claim 6, wherein said reinforcing layer forms an outer surface of said absorbent article.

8. An absorbent article as defined in claim 6, wherein said board of peat moss material includes an absorbent layer of peat moss material united in a face-to-face relationship with said reinforcing layer, said reinforcing layer being made of a fibrous material.

9. An absorbent article as defined in claim 8, wherein said board of peat moss material includes an upper reinforcing layer of fibrous material and a lower reinforcing layer of fibrous material, said absorbent layer of peat moss material being mounted between said upper and lower reinforcing layers of fibrous material.

10. An absorbent article as defined in claim 6, wherein said fibrous material is selected from the group consisting of Kraft wood pulp fibers, cotton linters, ground wood and mixtures thereof.

11. An absorbent article as defined in claim 1, wherein said board of peat moss material includes a component selected from the group consisting of polyester, nylon, acrylic, Kraft wood pulp, mechanical wood pulp, cotton linters, jute and mixtures thereof.

12. An absorbent article as defined in claim 1, wherein said board of peat moss material includes a water-repelling agent.

13. An absorbent article for recovering an oil-based liquid floating on a body of water, said absorbent article including a structurally integral and buoyant board of peat moss material, said board of peat moss material being hydrophobic and oleophilic, wherein when said board of peat moss material is floated on the body of water in contact with the oil-based liquid, said board of peat moss material selectively absorbs the oil-based liquid without taking-up any significant amount of water.

14. A method for manufacturing a low density, structurally integral article for collecting a non-aqueous liquid, said method comprising the steps of:

a) forming a liquid suspension of peat moss material;

b) sheeting said suspension on a layer of fibers;

c) extracting fluidizing medium from said suspension to form a low density board of peat moss material to cause said fibers to adhere to said peat moss material;

d) drying said board of peat moss material at a temperature above 100° C. to evaporate residual moisture;

said method being completed without conditioning said peat moss material with wetting agent to preserve a natural hydrophobicity of the peat moss material in order to impede water penetration in the article.

15. A method as defined in claim 14, comprising the step of forming an aqueous slurry of peat moss material to form said suspension.

16. A method as defined in claim 14, comprising the step of classifying said peat moss material to eliminate therefrom particles having a size smaller than 210 microns and particles having a size larger than 2000 microns.

17. A method as defined in claim 15, comprising the step of depositing over said suspension in sheeted form a layer of fibers, whereby the extraction of fluidizing medium from said suspension causes said fibers to adhere to said peat moss material.

18. A method as defined in claim 17, wherein said fibers are selected from the group consisting of Kraft pulp fibers, ground wood, cotton linters and mixtures thereof.

19. A method as defined in claim 14, comprising the step of combining with said peat moss material a component selected from the group consisting of polyester, nylon, acrylic, Kraft wood pulp, mechanical wood pulp, cotton linters, jute and mixtures thereof.

20. A method as defined in claim 15, comprising the step of treating said peat moss material and said layer of fibers with a water-repelling agent.

* * * * *